United States Patent [19]

Takagi

[11] Patent Number: 4,844,035

[45] Date of Patent: Jul. 4, 1989

[54] FUEL INJECTION DEVICE

[75] Inventor: Nobukazu Takagi, Higashi-matsuyama, Japan

[73] Assignee: Diesel Kiki Co., Ltd., Tokyo, Japan

[21] Appl. No.: 277,197

[22] Filed: Nov. 29, 1988

[30] Foreign Application Priority Data

Dec. 24, 1987 [JP] Japan ..... 62-196504[U]

[51] Int. Cl.[4] ..... F02M 39/00

[52] U.S. Cl. ..... 123/446; 123/357; 123/494

[58] Field of Search ..... 123/446, 357, 358, 359, 123/500, 501, 494; 73/119 A

[56] References Cited

U.S. PATENT DOCUMENTS

| | | | |
|---|---|---|---|
| 4,403,585 | 9/1983 | Ohie | 123/446 |
| 4,418,670 | 12/1983 | Lakin | 123/446 |
| 4,462,368 | 7/1984 | Funada | 123/446 |
| 4,619,233 | 10/1986 | Yamaguchi | 123/357 |
| 4,619,234 | 10/1986 | Okamoto | 123/357 |
| 4,625,918 | 12/1986 | Funada | 123/494 |
| 4,667,633 | 5/1987 | Stumpp | 123/357 |
| 4,669,440 | 6/1987 | Takase | 123/494 |
| 4,718,391 | 1/1988 | Rembold | 123/494 |
| 4,756,290 | 7/1988 | Moritugu | 123/494 |

*Primary Examiner*—Carl Stuart Miller

*Attorney, Agent, or Firm*—Wenderoth, Lind & Ponack

[57] ABSTRACT

A fuel injection device for internal combustion engines is disclosed, wherein the fuel injection quantity for each fuel injection is determined by deducting an amount of fuel which corresponds to the amount of piston overshooting detected when a booster piston forces fuel at the preceding fuel injection. The fuel injection thus determined is substantially equal to the desired fuel injection quantity.

1 Claim, 6 Drawing Sheets

FUEL INJECTION DEVICE

BACKGROUND OF THE INVENTION

1. Field of the Invention

The present invention relates generally to fuel injection devices for internal combustion engines, and more particularly to a control of the injection quantity of such a fuel injection device which includes a booster piston for forcibly feeding fuel to a fuel injection nozzle.

2. Description of the Prior Art

Fuel injection devices of the type described are known as disclosed, for example, in Japanese Patent Laid-open Publication No. 60-95457. In the disclosed device, the movement of a booster piston is detected by a lift sensor to adjust the injection timing according to the detected signals, thereby controlling the injection quantity of the fuel injection device.

The known fuel injection device is however disadvantageous in that the overshooting of the piston which is caused by the intertia acting on the piston and the delayed action of the electric circuitry is not taken into account at all when controlling the fuel injection. With this piston overshooting, the fuel injection still continues even after the termination of a control signal to the piston.

By the way, it has been experimentally admitted that the maximum piston displacement is closely correlated with the fuel injection quantity, as shown here in FIG. 6 of the accompanying drawings.

SUMMARY OF THE INVNENTION

It is accordingly an object of the present invention to provide a fuel injection device which is capable of correcting the fuel injection quantity to take up or cancel out the amount of overshooting of a piston based on an experimental rule established between the maximum piston displacement and the fuel injection quantity.

Another object of the present invention is to provide a fuel injection device capable of maintaining a desired injection quantity with accuracy even when injection conditions flactuate due to a change in the pressure of a working oil, a change in the response of a valve, etc.

According to the present invention, there is provided a fuel injection device comprising: injection timing computation means for computing a fuel injection timing according to operating conditions of an internal combustion engine; injection quantity computation means for computing a fuel injection quantity according to the operating conditions of the internal combustion engine; displacement computation means for computing a necessary amount of displacement for a booster piston forcing fuel to a fuel injection nozzle, based on a value computed by the injection quantity computation means; piston driver means for driving the booster piston according to a value computed by the injection timing computation means and a value computed by the displacement computation means; displacement detection means for detecting the displacement of the booster piston; counter means for counting a total number of injection achieved after the fuel injection device is started; monitor signal judgment meanas for making a judgment when a predetermined period of time has elapsed after the start of fuel injection, so as to determine whether a value detected by the displacement detection means is normal or not; reference displacement memory means for storing a value detected by the displacement detection means when the booster piston has been driven over a period of time corresponding to the computed value of the displacement computation means; maximum value memory means for detecting and storing a maximum value detected by the displacement detection meanas at each fuel injection; first difference computation means for computing the difference between the value stored in the reference displacement memory means and the value stored in the maximum value memory means; second difference computation means for computing the difference between the value computed by the displacement computation means and a value computed by the first difference computation means; drive signal changeover means for processing a value counted by the counter means and a result of judgment made by the monitor signal judgment means to select one of the value computed by the displacement computation means when the value counted by the counter means is 1, the value computed by the second difference computation means when the value counted by the counter means is more than 2 and the value detected by the displacement detection means is judged normal by the monitor signal judgment means, and the value computed by the displacement computation means when the value counted by the counter means is more than 2 and the value detected by the displacement detection means is judged abnormal by the monitor signal judgment means, and also for outputting the thus selected value to the piston drive means; comparator means for comparing the value detected by the displacement detection means with the value computed by the second difference computation means to determine the largeness of the thus compared values; and operation inhibition means for processing the value counted by the counter means and a result of comparation made by the comparator means to inhibit operation of the piston driver means when the value counted by the counter means is more than 2 and the value detected by the displacement detection means is larger than the value computed by the second difference computation means.

With this construction, the difference between the amount of displacement of the piston detected when the driver signal to the piston is terminated, and the maximum amount of piston displacement detected after the termination of the piston drive signal, namely the amount of piston overshooting is computed by the first difference computation means. The second difference compuation means computes the difference between the amount of piston overshooting and the amount of piston displacement corresponding to the desired injection quantity computed by the injection quantity computation means based on the engine operating coditions. The thus computed difference is used as a control factor in a feedback control which is achieved by the operation inhibition means for controlling the operation of the piston driver means.

In case the judgment by the monitor signal judgment means indicates that the piston displacement which is detected when a predetermined period of time has expired after the start of the fuel injection goes beyond a predetermined range, the value computed by the injection quantity computation means is selected in preference to the value computed by the second difference computation means for driving the piston, thus preventing undue fluctuation of the injection quantity even under accidental conditions.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A preferred embodiment of the present invention will be described hereinbelow in greater detail with reference to the accompanying drawings.

Figure 1:
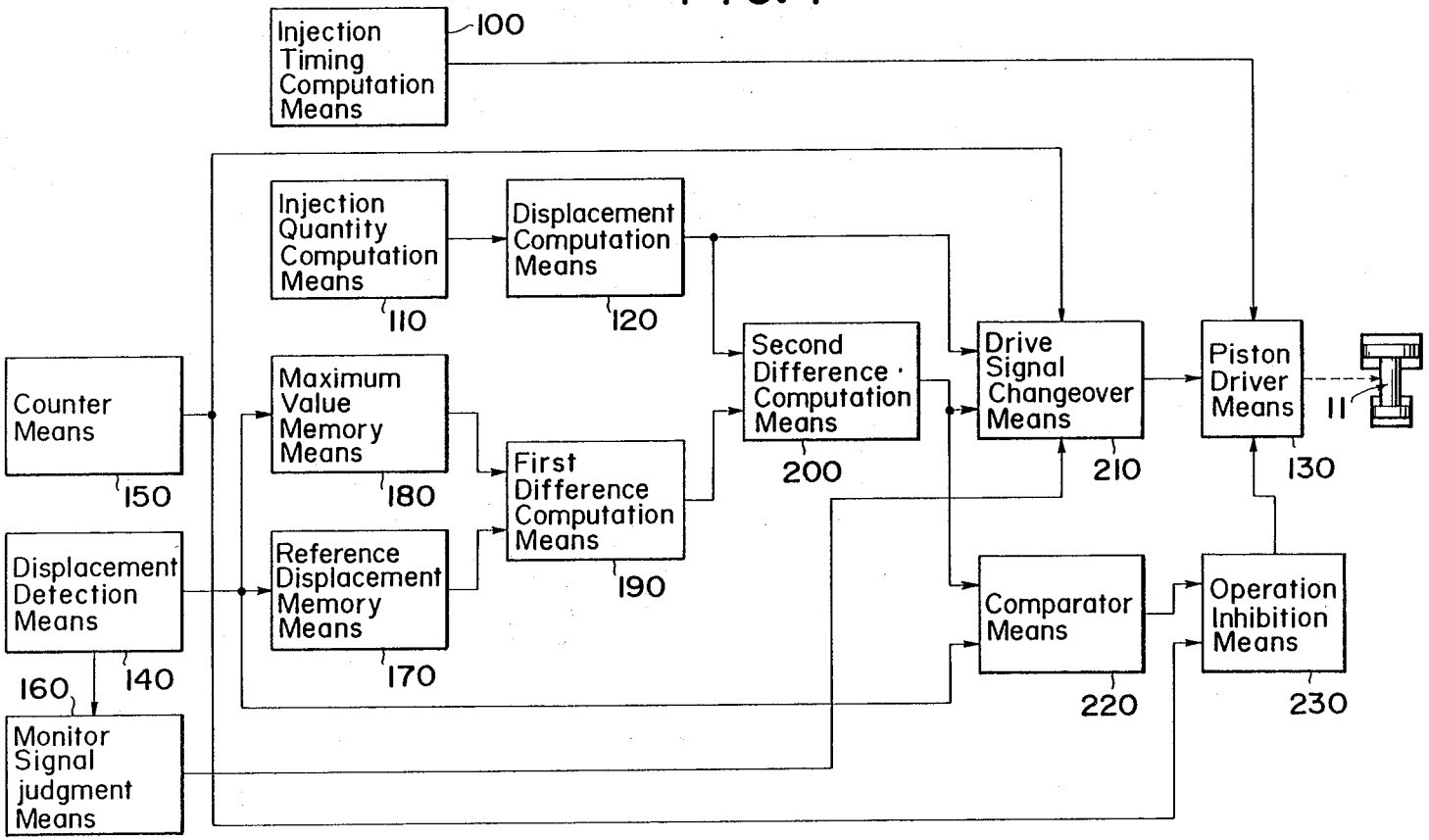
FIG. 1 is a block diagram showing the general construction of a fuel injection device according to the present invention.
Figure 2:
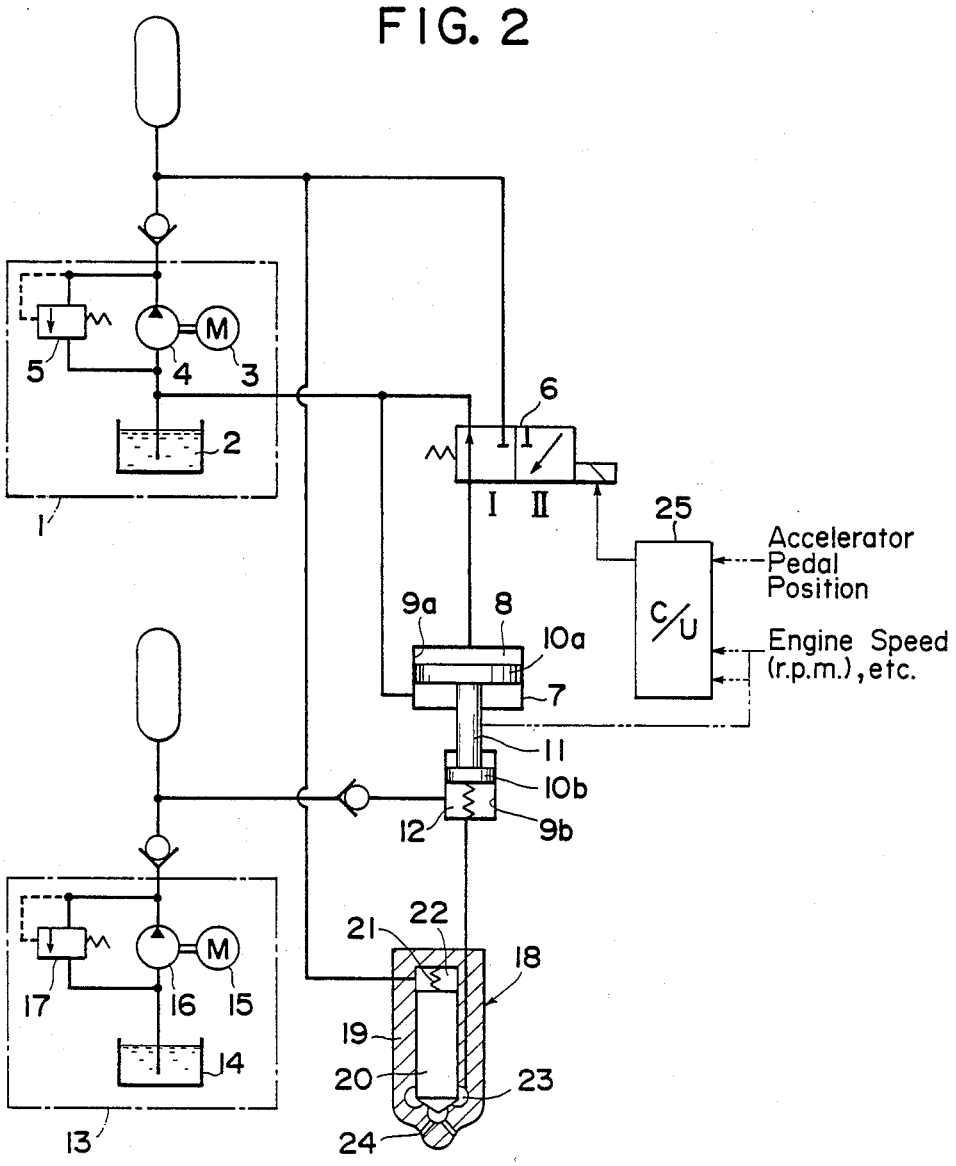
FIG. 2 is a diagrammatical view showing the general construction of the fuel injection device.

FIG. 2 shows the general construction of a fuel injection device embodying the present invention. The fuel injection device include a fluid pressure supply source 1 for supplying a working oil to a booster piston described later on, a working oil tank 2 of a conventional construction containing the working oil, a motor 3, a feed pump 4 and a relief valve 5. With this arrangement, the working oil is withdrawn from the working oil tank 2 by the feed pump 4 and is fed through a solenoid-operated changeover valve 6 to a large-diameter piston chamber 8 in a fuel intensifier or booster 7.

The fuel booster 7 has a large-diameter upper bore 9*a* and a small-diameter lower bore 9*b* intercommunicated together, and a booster piston 11 having a large-diameter piston 10*a* and a small-diameter piston 10*b* slidably received in the large-diameter bore 9*a* and the small-diameter bore 9*b*, respectively, so as to define therebetween the large-diameter piston chamber 8 stated above and a compression chamber 12, respectively, at upper and lower ends of the fuel booster 7. The compression chamber 12 is supplied with a fuel which is fed from a fuel supply source 13.

The fuel supply source 13 includes a fuel tank 14, a motor 15, a feed pump 16 and a relief valve 17. Upon operation, the feed pump 16 serves to withdraw the fuel and force the same to the compression chamber 12.

When the working oil is supplied into the large-diameter piston chamber 8, the booster piston 11 is moved downwardly to compress the fuel within the compression chamber 12, thereby forcing the thus compressed fuel to the fuel injection nozzle 18.

The fuel injection nozzle 18 is of the type generally called as automatic vlaves and includes a valve body 19, a needle valve 20 movably disposed in the valve body 19, a spring 21 for urging the needle valve 20 in a direction to close the valve, and a pressure chamber 22 into which the pressurized working oil is introduced for urging the needle valve 20 in the same direction as the force of the spring 21. The fuel injection nozzle 18 further has an annular fuel sump 23 into which the pressurized fuel is supplied from the fuel booster 7. When the pressure of fuel acting on the tapering end portion of the needle valve 20 exceeds a combined force or pressure of the force of the spring 21 and the pressure of the pressure chamber 22, the needle valve 20 is lifted upwardly against the combined force to thereby cause an injection hole 24 to open. As a result, the fuel is injected from the injection hole 24. Upon injection, the pressure in the fuel sump 23 drops whereupon the needle valve 20 is lowered by the aforesaid combined force, thereby closing the valve.

The solenoid-operated changeover valve 6 is constructed to operate under the control of a control unit 25 based on engine operating conditions such as the accelerator pedal position, engine speed (r.p.m.), piston displacement, etc.

Figure 3:
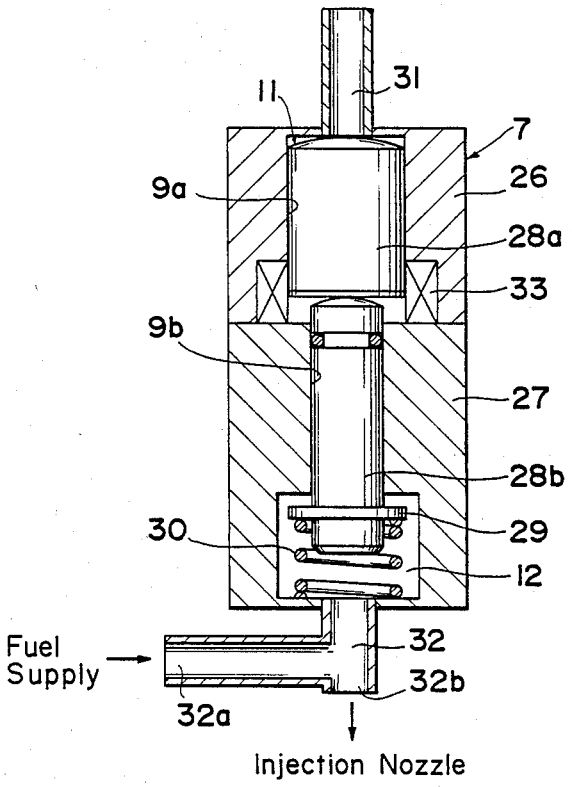
FIG. 3 is an enlarged cross-sectional view of a booster piston incorporated in the fuel injection device.
Figure 6:
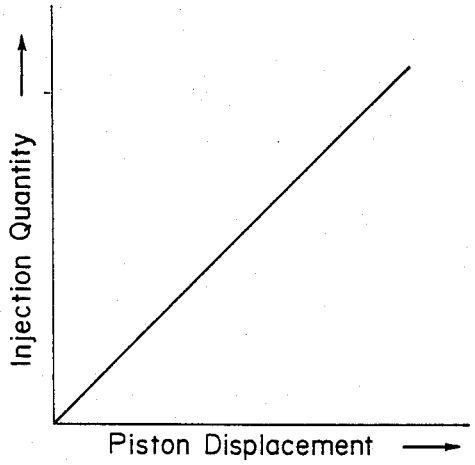
FIG. 6 is a graph showing a correlation established between the piston displacement and the injection quantity.

The fuel booster 7 is illustrated in greater detail in FIG. 3.

The fuel booster 7 includes a pair of cylindrical members 26, 27 joined concentrically to form first and second piston bodies. The first piston body 26 is formed with the large-diameter bore 9*a* while the second piston body is formed with the small-diameter bore 9*b*, both bores 9*a*, 9*b* being mutually communicated.

The booster piston 11 is slidably received in the bores 9*a*, 9*b* and includes a primary piston portion 28*a* disposed in the large-diameter bore 9*a* and a secondary piston portion 28*b* disposed in the small-diameter bore 9*b*. The secondary piston portion 28 has an upper end held in abutment with the lower end face of the primary piston portion 28*a*. The lower end part of the secondary piston portion 28*b* projects into the compression chamber 12 which is formed in the second piston body 27 in contiguous to the small-diameter bore 9*b*. The compression chamber 12 receives therein a return spring 30 acting between the bottom wall of the compression chamber 12 and a spring retainer 29 formed on the secondary piston portion 28 adjacent to the lower end thereof. Thus, the booster piston 11 is normally urged upwardly.

The pressure chamber 12 is connected with a secondary pressure passage 32 disposed below the second piston body 27. The secondary pressure passage 32 is bifurcated at one end and has two connecting openigns 32*a*, 32*b*. One 32*a* of the connecting openings 32*a*, 32*b* is connected through a non-illustrated pipe to the fuel supply source 13, the other 32*a* of the connecting openings 32*a*, 32*b* is connected through a non-illustrated pipe to the fuel injection nozzle 18.

The first piston body 26 has a displacement sensor 33 embedded therein and facing the bore 9*a* to detect the amount of displacement of the booster piston 11 in terms of a change in inductance for produciang a signal corresponding to the detected piston displacement. The thus produced signal is supplied to the control unit 25.

With this construction, when the working oil of a predetermined pressure is supplied to the large-diameter bore 9*a* through a primary pressure passage 31 connected to the top wall of the first piston body 26, the booster piston 11 is displaced downwardly against the force of the return spring 30. With this downward movement of the booster piston 11, the fuel in the compression chamber 12 is compressed and forcibly fed to the fuel injection nozzle 18.

Figure 4:
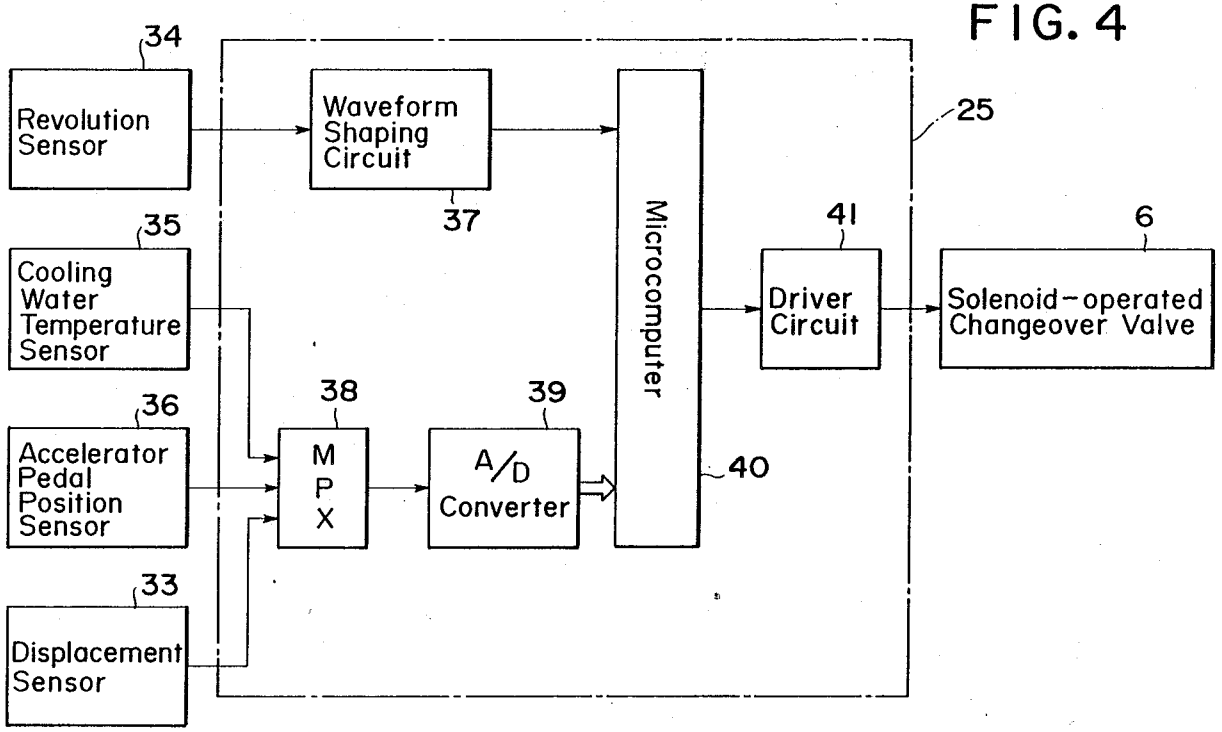
FIG. 4 is s block diagram showing a control unit of the fuel injection device shown in FIG. 2.

The control unit 25 comprises, as shown in FIG. 4, a microcomputer 40 of a known construction including a central processing unit (CPU), a read-only memory (ROM), a random access memory (RAM), a clock pulse generator, an input/output control unit (I/0), etc. The microcomputer 40 receives via a waveform shaping circuit 37 an output singal representing the engine speed (r.p.m.) supplied from a revolution sensor 34. Likewise, an output signal representing the temperature of engine cooling water detected by a cooling water temperature sensor 35, an output signal representing the position of an accelerator pedal detected by an accelerator pedal position sensor 36, and an output signal from the displacement sensor 3 are supplied to the microcomputer 40 through a multiplexer (MPX) 38 and an A/D converter 39. The microcomputer 40 is constructed to compute a control signal in accordance with a program stored in the read-only memory (ROM). The thus computed control signal is coverted into a predetermined signal form, then amplified by a driver circuit 41, and finally delivered therefrom to the solenoid-operated changeover valve 6. The operation of the microcomputer 40 is performed in accordance with a program routine shown in FIGS. 5(*a*) and 5(*b*).

Figure 5A:
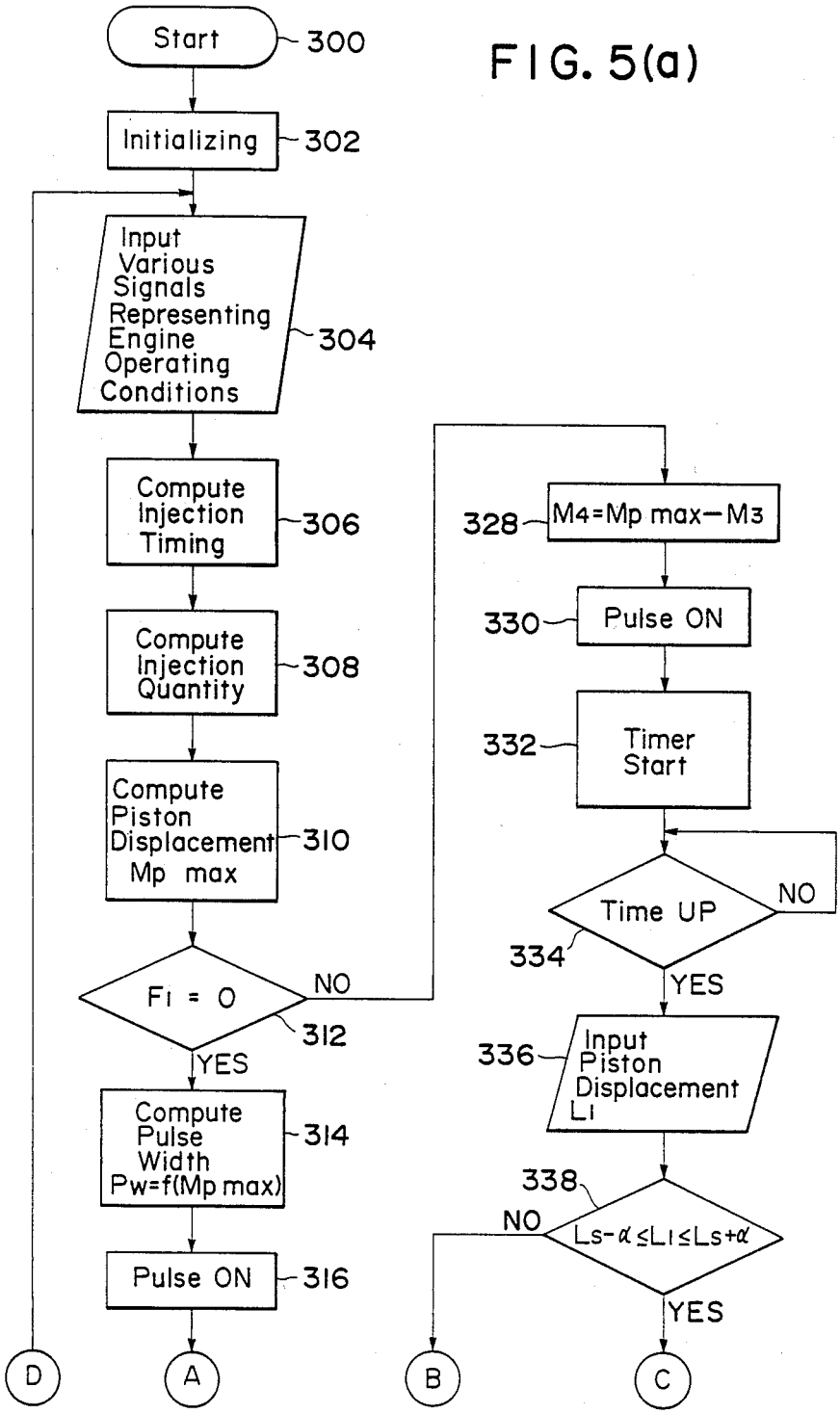
FIGS. 5(*a*) and 5(*b*) are flowcharts showing a control program routine achieved in a microcomputer of the control unit.
Figure 5B:
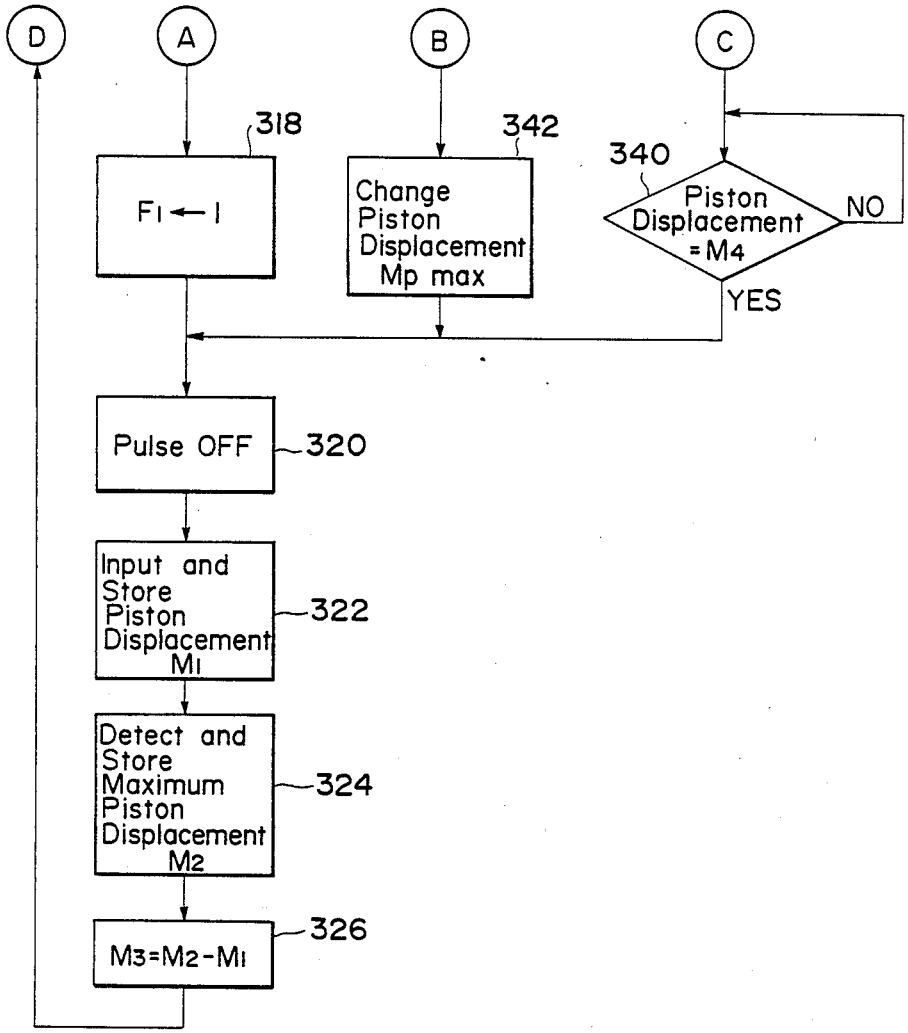

As shown in FIG. 5(*a*), the operation of the microcomputer 40 is started in a step 300 upon actuation of a non-illustrated power switch. The operation proceeds to the next step 302 for clearing up or initialization. In this instance, the flag F1, for example, is set to zero.

Then output signals supplied respectively from the revolution senssor 34, cooling water temperature sensor 35 and the accelerator pedal position sensor 36 are inputted in a step 304. These output signals represent the currect operating conditions of the internal combustion engine.

Thereafter, the injection timing is computed in a step 306 based on the thus inputted signals so as to determine an adequate injection timing corresponding to the detected engine operating conditions.

Likewise, the injection quantity is computed in a step 308 based on the aforesaid signals for determining an adequate fuel injection quantity corresponding to the detected engine operating conditions.

Then the operation proceeds to a step 310 in which a computation is achieved to determine a desired amount of displacement Mpmax of the booster piston 11 which is corresponding to the computed fuel injection quantity.

In the next following step 312, a judgment is made to determine whether the counting flag value is zero or not. When zero (YES), then the operation proceeds to a step 314. Alternately, when the judgment indicates a value other than zero (NO), then the operation proceeds to a step 328. The counting flag F1 is used for the judgment between the first fuel injection and the second or even subsequent fuel injection. To this end, the counting flag F1 is set to zero (0) when the first fuel injection takes place. Upon completion of the first fuel injection, the counting flag F1 is set to one (*1*), thus enabling it to discriminate the second and subsequent fuel injection.

Then, the pulse width or duration Pw of a drive pulse which is to be applied to the solenoid-operated changeover valve 6 to obtain the desired amount of displacement Mpmax is computed in a step 314. The operation proceeds to the next step 316 in which the drive pulse signal is supplied to the solenoid-operated changeover valve 6 via the driver circuit 41. As a result, the changeover valve 6 is driven to shaft its valve position from a first position indicated by "I" in FIG. 2 to a second position indicated by "II" in the same figure, thereby urging the booster piston 11 into a direction to inject fuel.

In the next following step 318 shown in FIG. 5(*b*), the counting flag F1 is set to one (1).

After the drive pulse having a pulse width Pw has been issued, supply of such drive signal to the solenoid-operated changeover valve 6 is terminated in a step 320. At the same time, the amount of displacement of the booster piston 11 is detected by the displacement sensor 33. The thus detected displacement value is read and stored in a variable M1 in a step 322.

The operation proceeds to the next following step 324 in which the maximum value of displacement of the booster piston 11 is detected and stored in a variable M2. This step is achieved in view of the fact that even after the termination of the drive pulse to the solenoid-operated changeover valve 6, the booster piston 11 continues its movement due to inertia, etc., thus causing an overshooting. Thus, the maximum piston displacement including the amount of overshooting is detected in the step 324.

The difference between the variable M1 stored in the step 322 and the variable M2 stored in the step 324 is computed and stored in a variable M3 in a step 326. The difference is equivalent to the amount of overshooting deperting from the desired amount of piston displacement M1. The operation returns to the the step 304 (FIG. 5(*a*)) and then the foregoing steps of operation will be repeated in the same manner as described above.

When the next following or second fuel injection takes place, the operation proceeds to the step 328 based on the judgment made in the step 312. In the step 328, the amount of overshooting of the booster piston 11 which was detected at the preceding fuel injection and stored in the variable M3 in the step 326 is deducted or subtracted from a desired amount of displacement Mpmax for the booster piston 11 which is corresponding to a desired injection quantity for the next fuel injection. The value obtained by this subtraction is substituted for a variable M4. The variable M4 shows a modified or compensated amount of displacement of the booster piston 11 to be achieved at the present fuel injection in view of the piston overshooting observed at the preceding fuel injection.

The solenoid-operated changeover valve 6 is supplied with a drive signal in a step 330. At the same time, the timer is started in a step 332 to set a predetermined period of time. This time period is considerably shorter than (for instance, three-fifths of) a pulse width or duration of the drive pulse which is required to realize the variable M4 computed in the step 328.

In the next step 334, a judgment is made to determine whether the predetermined period of time set by the timer has elapsed. If the judgment indicates the elapse of the predetermined period of time (YES), then the operation proceeds to a step 336. Conversely, if the judgment indicates continuing operation of the timer (NO), then the same judgment is repeated until the operation of the timer is terminated.

In the step 336, the amount of displacement L1 of the booster piston 11 is detected and inputted upon termination of operation of the timer. Then the operation proceeds to a step 338 in which a judgment is made to determine as to whether the amount of piston displacement L1 is normal or not. If this amount L1 comes within a predetermined range ($\pm\alpha$) relative to a reference amount of piston displacement which is expected to be obtained during the predetermined period of time set by the timer, the judgment indicates a normal condition (YES). In this case, the operation proceeds to a step 340 shown in FIG. 5(*b*). If not so, the judgment shows an obnormal or accidental condition (NO), then the operation proceeds to a step 342.

In the step 340, a judgment is made to determine as to whether the amount of displacement of the booster piston 11 becomes equal to the aforesaid value M4 or not. If YES, the operation proceeds to the step 320, thereby terminating the drive signal. Conversely, if NO, then the same judgment is repeated until the amount of piston displacement bocomes equal to the value M4.

On the other hand, in the step 342, the amount of displacement of the booster piston 11 is changed from the value M4 to the value Mpmax which is determined in the step 310. When the piston displacement corresponding to the value Mpmax is obtained, the operation proceeds to the step 320, thereby terminating the drive signal.

As described above, when the fuel injection device is operated by a start switch (not shown), a first fuel injection is effected based on such an injection timing and such an injection quantity which are computed in accordance with the engine operating conditions.

In the next or second fuel injection, the injection timing and the injection quantity are computed again according to the engine operating conditions at that time. The thus computed injection quantity, which is equivalent to the amount of displacement of the booster piston 11, is not equal to the amount of piston displacement determined solely by the engine eperating conditions. Rather, this amount of piston displacement has been modified or compensated in such as manner as to remove or deduct the amount of piston overshooting detected at the first injection, from the amount of piston displacement obtained based solely on the engine oprating conditions. In this instance, however, if an abnormal value for the piston displacement is detected during movement of the booster piston 11, the foregoing compensation is not effected but the booster piston 11 is driven to inject an amount of fuel which is determined by computation based exclusively on the engine operating conditions.

At the next following or third fuel injection, the amount of overshootig of the booster piston 11 detected at the second or preceding fuel injection is compensated to determine a desired injection quantity for the third fuel injection. In this way, when effecting a fuel injection, the piston overshooting detected at the preceding injection is taken into account for the control the the next following injection.

Obviously, various modifications and variations of the present invention are possible in the light of the above teaching. It is therefore to be understood that within the scope of the appended claims the invention may be practiced otherwise than as specifically described.

What is claimed is:

1. A fuel injection device comprising:

(a) injection timing computation means for computing a fuel injection timing according to operating conditions of an internal combustion engine;

(b) injection quantity computation means for computing a fuel injection quantity according to the operating conditions of the internal combustion engine;

(c) displacement computation means for computing a necessary amount of displacement for a booster piston forcing fuel to a fuel injection nozzle, based on a value computed by said injection quantity computation means;

(d) piston driver means for driving said booster piston according to a value computed by said injection timing computation means and a value computed by said displacement computation means;

(e) displacement detection means for detecting the displacement of said booster piston;

(f) counter means for counting a total number of injection achieved after said fuel injection device is started;

(g) monitor signal judgment means for making a judgment when a predetermined period of time has elapsed after the start of fuel injection,. so as to determine whether a value detected by said displacement detection means is normal or not;

(h) reference displacement memory means for storing a value detected by said displacement detection means when said booster piston has been driven over a period of time corresponding to said computed value of said displacement computation means;

(i) maximum value memory means for detecting and storing a maximum value detected by said displacement detection means at each fuel injection;

(j) first difference computation means for computing the difference between said value stored in said reference displacement memory means and said value stored in said maximum value memory means;

(k) second difference computation means for computing the difference between said value computed by said displacement computation means and a value computed by said first difference computation means;

(l) drive signal changeover means for processing a value counted by said counter means and a result of judgment made by said monitor signal judgment means to select one of said value computed by said displacement computation means when said value counted by said counter means is 1, said value computed by said second difference computation means when said value counted by said counter means is more than 2 and said value detected by said displacement detection means is judged normal by said monitor signal judgment means, and said value computed by said displacement computation means when said value counted by said counter means is more than 2 and said value detected by said displacement detection means is judged abnormal by said monitor signal judgment means, and also for outputting the thus selected value to said piston drive means;

(m) comparator means for comparing said value detected by said displacement detection means with said value computed by said second difference computation means to determine the largeness of the thus compared values;

(n) and operation inhibition means for processing said value counted by said counter means and a result of comparison made by said comparator means to inhibit operation of said piston driver means when said value counted by said counter means is more than 2 and said value detected by said displacement detection means is larger than said value computed by said second difference computation means.

* * * * *